US009066542B2

(12) United States Patent
Fiebelkorn

(10) Patent No.: US 9,066,542 B2
(45) Date of Patent: Jun. 30, 2015

(54) FILTER FOR A SMOKING ARTICLE

(75) Inventor: Richard Fiebelkorn, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 1230 days.

(21) Appl. No.: 12/995,232

(22) PCT Filed: May 27, 2009

(86) PCT No.: PCT/GB2009/050573
§ 371 (c)(1),
(2), (4) Date: Mar. 21, 2011

(87) PCT Pub. No.: WO2009/144496
PCT Pub. Date: Dec. 3, 2009

(65) Prior Publication Data

US 2011/0155155 A1 Jun. 30, 2011

(30) Foreign Application Priority Data

May 30, 2008 (GB) ..... 0809865.9

(51) Int. Cl.
*A24D 3/04* (2006.01)

(52) U.S. Cl.
CPC ..... *A24D 3/043* (2013.01); *Y10T 156/1056* (2015.01); *A24D 3/04* (2013.01)

(58) Field of Classification Search
CPC ..... A24D 3/04; A24D 3/043
USPC ..... 131/336, 341, 344
See application file for complete search history.

(56) References Cited

U.S. PATENT DOCUMENTS

| | | | | |
|---|---|---|---|---|
| 3,752,165 | A | 8/1973 | Harllee et al. | |
| 3,768,489 | A | 10/1973 | Kiefer et al. | |
| 4,135,523 | A | 1/1979 | Luke et al. | |
| 4,256,122 | A | 3/1981 | Johnson | |
| 4,350,173 | A * | 9/1982 | Siren | 131/332 |
| 4,406,294 | A | 9/1983 | Lamb | |
| 4,527,572 | A | 7/1985 | Luke | |
| 4,527,573 | A | 7/1985 | Hausermann | |
| 4,552,158 | A | 11/1985 | Berger | |
| 4,557,281 | A | 12/1985 | Litzinger | |
| 4,580,584 | A | 4/1986 | Reynolds et al. | |
| 4,593,707 | A | 6/1986 | Seidel et al. | |

(Continued)

FOREIGN PATENT DOCUMENTS

| | | | |
|---|---|---|---|
| AU | 2006202993 | A1 | 8/2006 |
| EP | 0476969 | A1 | 3/1992 |
| EP | 0664964 | A2 | 8/1995 |

(Continued)

OTHER PUBLICATIONS

Office Action issued in corresponding Canadian Application No. 2,725,121, mailed Apr. 30, 2012.

(Continued)

*Primary Examiner* — Anthony Calandra
(74) *Attorney, Agent, or Firm* — NW Poulsen

(57) ABSTRACT

A multi-section filter (5) for a smoking article comprises at least a first (5B) and a second filter section (5A). The first filter section (5B) is at a mouth end of the filter (5) and the second filter section includes a set of ventilation holes (17) and a set of grooves (7). The grooves (7) extend from respective ventilation holes (17) along the second filter section (5A) up to but not into the first filter section (5B).

27 Claims, 4 Drawing Sheets

(56) References Cited

U.S. PATENT DOCUMENTS

| | | | |
|---|---|---|---|
| 6,202,650 | B1 | 3/2001 | Kaneki et al. |
| 7,237,558 | B2 | 7/2007 | Clark et al. |

FOREIGN PATENT DOCUMENTS

| | | | |
|---|---|---|---|
| EP | 1321050 | | 6/2003 |
| EP | 1797780 | | 6/2007 |
| FR | 2496416 | A1 | 6/1982 |
| FR | 2521405 | | 8/1983 |
| FR | 2524775 | A1 | 10/1983 |
| GB | 1308661 | | 2/1973 |
| GB | 2046573 | A | 11/1980 |
| GB | 1585862 | | 3/1981 |
| GB | 2088191 | A | 6/1982 |
| GB | 2088193 | A | 6/1982 |
| GB | 2088692 | A | 6/1982 |
| GB | 2089641 | A1 | 6/1982 |
| GB | 2090117 | A | 7/1982 |
| GB | 2098051 | A | 11/1982 |
| GB | 2118819 | A | 11/1983 |
| GB | 2150412 | A | 7/1985 |
| GB | 2150809 | A | 7/1985 |
| JP | 04-079875 | | 3/1992 |
| SU | 1382393 | | 3/1988 |
| WO | WO03051144 | A1 | 6/2003 |
| WO | WO2008017960 | A2 | 2/2008 |

OTHER PUBLICATIONS

English Translation of Russian Office Action dated Nov. 27, 2013, for Russian Patent Application No. 2010 153 373, filed May 27, 2009.

Office Action issued in Russian Patent Application No. 2010153373, dated Mar. 12, 2013, with English Translation.

International Search Report and Written Opinion corresponding to PCT/GB2009/050573 mailed Sep. 23, 2009.

International Preliminary Report on Patentability corresponding to PCT/GB2009/050573 mailed Aug. 12, 2010.

* cited by examiner 6
7
11

13
7
11

17
51

15

FILTER FOR A SMOKING ARTICLE

CLAIM FOR PRIORITY

This application is a National Stage Entry entitled to and hereby claims priority under 35 U.S.C. §§365 and 371 to corresponding PCT Application No. PCT/GB2009/050573, filed May 27, 2009, which in turn claims priority to British Application Serial No. GB 0809865.9, filed May 30, 2008. The entire contents of the aforementioned applications are herein expressly incorporated by reference.

FIELD OF THE INVENTION

The invention relates to multi-section filters for smoking articles, for example, for cigarettes.

BACKGROUND TO THE INVENTION

Cigarettes typically include a tobacco rod and a filter. The filter is located at the mouth end of the cigarette, between the smoker and the tobacco rod. The filter modifies the tobacco smoke (mainstream smoke) drawn through it. Filters may be intended to reduce or alter various smoke constituents, including particulate matter and/or vapour phase matter.

Multi-segment filters are becoming more common. For example, in one arrangement a filter includes a section comprising activated carbon, which has good filtration properties. The filter may include another section between the activated carbon and the mouth-end of the cigarette. This helps to ensure that the activated carbon does not enter the mouth of the user.

There are many known techniques for altering filter behaviour. One technique is to include ventilation holes in the outside of the filter. This allows air to be drawn into the filter, and so dilutes the cigarette smoke inhaled by a user. Another known technique is to provide grooves in a filter, often along the outside of the filter. These grooves can be used to control flow properties through the filter. Examples of grooves and/or ventilation holes can be found in: WO 03/051144; GB 2150809; GB 2150412; GB 2118819; GB 2089641; GB 2088692; GB 2088193; GB 2088191; GB 1585862; GB 1308661; EP 047969; U.S. Pat. No. 4,527,573; U.S. Pat. No. 4,527,572; U.S. Pat. No. 4,256,122; U.S. Pat. No. 4,135,523; U.S. Pat. No. 3,768,489; and U.S. Pat. No. 3,752,165.

It remains desirable to provide improved filtration properties for a multi-segmented filter.

SUMMARY OF THE INVENTION

One embodiment of the invention provides a multi-section filter for a smoking article. The filter comprises at least first and second filter sections. The first filter section is at a mouth end of the filter. The second filter section includes a set of ventilation holes and a set of grooves or channels. The grooves extend from respective ventilation holes along the second filter section towards but not into the first filter section.

Such a filter allows separation from the external entrance of air into the filter from the atmosphere (also referred to herein as the actual air entry point), which occurs at the start of the grooves, and the internal entrance of air into the main body of the filter where it joins the mainstream smoke, which occurs at the end of the grooves (also referred to as the ventilation hole position or ventilation zone). This gives increased flexibility in the filter design. For example, the external air entrance is relatively far from the mouth end, thereby reducing the risk of the external entrance of the air becoming occluded by the smoker, while allowing the air to mix with the smoke relatively near to the mouth end of the filter. The area of filter material between the actual air entry point and the ventilation hole position, is subject to a slower flow of smoke for any given puff than would be the case if the diluting air entered the body of the filter at the position of the ventilation holes. The reduced velocity results in the smoke being subject to an increased level of filtration. This also makes the filter particularly suited to having a multi-segmented configuration, and especially a configuration wherein filter sections contain adsorbent materials, such as carbon, to enhance the filtration of particular toxicants. The grooves may be restricted to a single segment of the filter, for ease of filter construction.

In one particular embodiment, the grooves extend along the outside of the filter body parallel with a major axis of the filter. The grooves are substantially non-permeable along their length. The grooves extend substantially the length of the second filter section. The filter is arranged such that air passes through the ventilation holes, travels along the grooves towards the first filter section and exits the grooves into a body portion of the filter adjacent the first filter section. There are three filter sections in an end-to-end arrangement in this particular embodiment, and the second (grooved) filter section comprises the middle section of the filter. The second filter section has a non-permeable inner plug-wrap and is joined to the other filter sections with a permeable outer plug-wrap. The grooves are located between the inner plug-wrap and the outer plug-wrap, and the body of the second filter section is therefore separated from the grooves by a non-permeable barrier. The filter is then joined to the tobacco rod with an outer non-permeable tipping layer through which ventilation holes are formed. Accordingly, the grooves are substantially impermeable to air and smoke entering or leaving the filter body. The only air ingress into the grooves is via the ventilation holes in the outer tipping and then through the permeable outer plug-wrap into the grooves. This diluting air travels along the grooves to enter the filter body at or towards the junction of the first and second filter sections.

In some embodiments, all the ventilating air entering through the ventilation holes is directed along the grooves. In other embodiments, a groove extends from some of the ventilation holes in the ventilation zone, and but other ventilation holes are directed into a body portion of the filter section, thus some of the ventilating air enters the filter body directly at the position of the ventilation zone. These additional ventilation holes of the ventilation zone may be directed into a body portion of the filter section between the grooves. The additional ventilation holes may be directed into the body portion near the ends of the grooves furthest away from the first filter section (mouth end), and/or the additional ventilation holes may be directed into the body portion near the ends of the grooves closest to the first filter section.

In a further embodiment, the tipping is fabricated from a naturally permeable material, and thus ventilating air can enter the grooves over the whole length of the second filter section. Additional ventilation holes may also be added to further enhance the overall ventilation level.

These different configurations give considerable flexibility in the design and operation of the filter. For example, some air can be made to enter the body of the grooved filter section to mix there with the main smoke flow, and further air (from the grooves) can be made to mix with smoke as it enters the first filter section.

In one embodiment, the ventilation holes are located at least about 11 mm from the mouth end of the first filter section. For example, the ventilation holes may be located from about 12 to about 25 mm from the mouth end of the first filter section.

In one embodiment, a barrier is located at the end of each groove furthest away from the first filter section. The barrier ensures that entry into this end of the grooves occurs only via the ventilation holes. The barrier may be provided by hot melt fusion of the filter material, by glue applied to the end of each groove, or by an annular member located at the end of the second filter section furthest away from the first filter section, or by any other suitable mechanism. In a further embodiment, the barrier is provided due to the fact that the grooves in the second section only extend part way along the filter section, such that the open ends of the grooves butt up against the end of the first filter section.

The invention also provides a smoking article incorporating a tobacco rod and such a multi-section filter.

The invention further provides a smoking article comprising a tobacco rod and a multi-section filter having at least first and second filter sections, wherein the first filter section is at a mouth end of the filter and wherein the second filter section includes a set of ventilation holes and a set of grooves, the grooves extending from respective ventilation holes along the second filter section towards but not into the first filter section.

Another embodiment of the invention provides a method of making a smoking article comprising: combining a grooved second filter section and a mouth end filter section by overlaying the grooved filter section with a permeable plug-wrap and then overlaying the combined grooved and mouth-end filter sections with a tipping paper which contains ventilation holes, wherein the position of some or all of the ventilation holes corresponds to the position of the grooves. Further sections can be added to the tobacco end of the second section during combining. The grooves may be blocked at the end opposite to the mouth end during the combining operation. In some embodiments this blockage is done by addition of adhesive. Alternatively, the blockage is done by hot melt of the filter material, or by addition of an annular material at the end of the grooved filter section.

The ventilation holes can be easily applied using standard on-machine laser techniques such as on-line or off-line perforation.

In one particular embodiment, the grooved filter section is made by shaping a filter rod or by shaping a plug-wrap and wrapping the shaped plug-wrap around a filter rod.

Another method of making a smoking article comprises combining a fully grooved second filter section with a mouth end section within a porous plug-wrap, the grooves within the second section being blocked at the tobacco end by the addition of material such as adhesive applied in spots or a band around the filter during the combining. Further sections can be added to the tobacco end of the second section during the combining.

Another method of making a smoking article comprises combining a fully grooved second filter section within first and third filter sections, and inserting an annular material between the second and third filter sections such that the end of the grooves are blocked by the annular material.

BRIEF DESCRIPTION OF THE DRAWINGS

Embodiments of the invention are described, by way of example only, with reference to the accompanying drawings in which.

DETAILED DESCRIPTION

Figure 1:
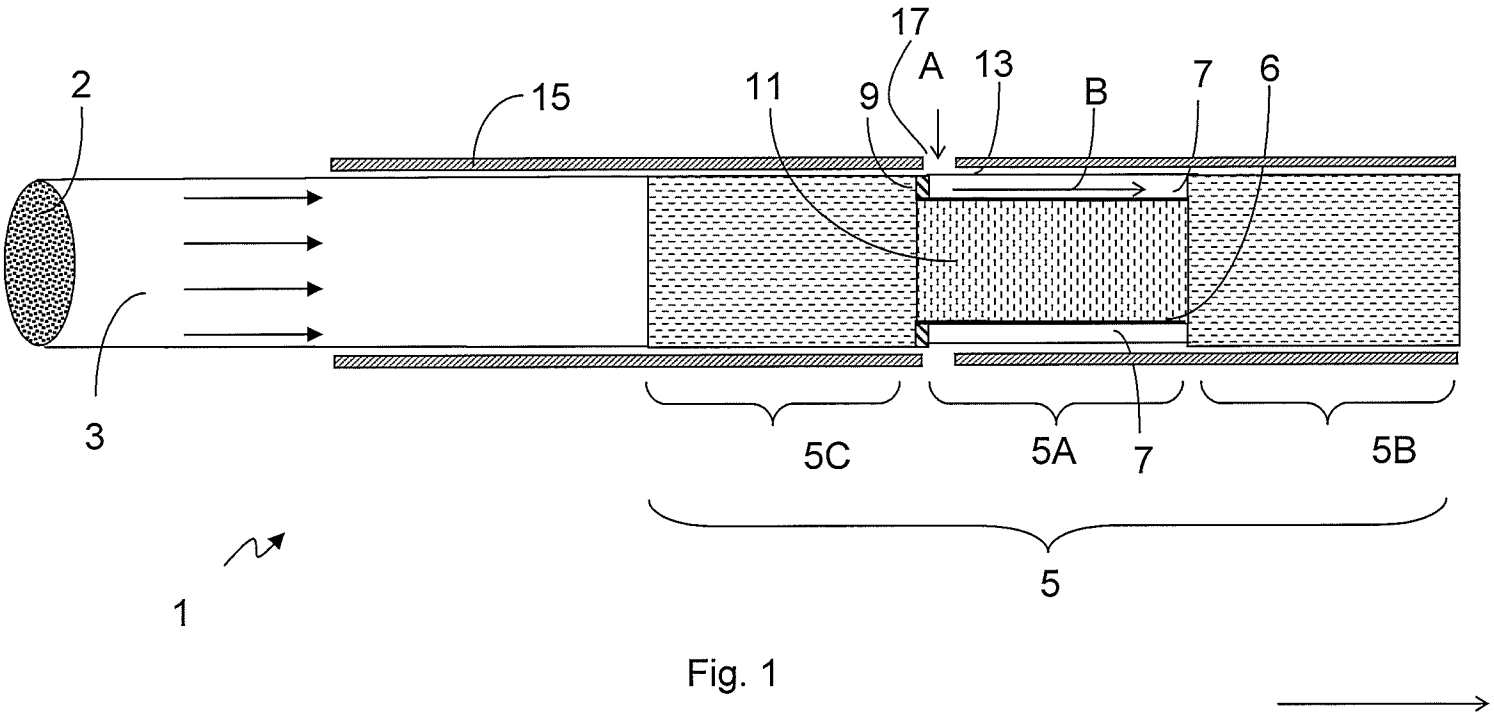
FIG. 1 depicts a longitudinal cross-section of a cigarette comprising a multi-section filter in accordance with one embodiment of the invention.

FIG. 1 depicts a cigarette 1 comprising a tobacco rod 3 and a multi-section filter 5, which can be held together by tipping paper 15 as is well-known in the art. The multi-section filter 5 is made up of three filter sections 5A, 5B, 5C arranged end-to-end. In particular, filter 5 comprises a grooved middle filter section 5A, a mouth-end filter section 5B, and a filter section 5C adjacent to the tobacco rod 3. The grooved filter section 5A is arranged in the middle between the other two filter sections 5B, 5C (with respect to the main cylindrical axis of the filter). The grooves 7 are located on the outside of the filter and extend in a generally axial direction. The filter section 5A is provided with a plurality of grooves 7, which are distributed around the circumference of filter section 5A. The grooves extend along substantially the length of the middle filter section 5A, from near the tobacco end section 5C to the mouth-end section 5B. However, the grooves do not extend into the tobacco-end filter section 5C or into the mouth end filter section 5B.

The grooves 7 are separated from the tobacco-end filter section 5C by an impermeable barrier 9. Likewise, the grooves are separated from the body 11 of the middle filter section 5A by an impermeable layer 6. However, the grooves are open at the end opposite barrier 9 to allow air or other gas/vapour flowing along groove 7 to pass into the mouth-end filter section 5B.

In one embodiment, the impermeable layer 6 comprises a non-porous plug-wrap which surrounds (the circumference of) the body of filter material 11 in filter section 5A. This filter material 11 may comprise any suitable filter material or structure, for example cellulose acetate tow, paper, etc. The filter material may be provided with one or more additives, such as activated carbon, etc. The non-porous plug-wrap 6 may be corrugated to define grooves 7 (with the corrugations running parallel to the cylindrical axis of the filter). The filter material 11 inside the non-porous plug-wrap will generally deform to occupy all the space inside the non-porous plug-wrap.

The individual filter sections are combined with a porous outer plug-wrap 13. This outer plug-wrap then sits on the ridges or raised corrugations of the inner plug-wrap, with the grooves being formed between the outer plug-wrap and the lower (reduced radius) portions of the inner plug-wrap 6.

In use, a smoker draws on the mouth-end section of the filter 5B. This causes smoke from the combustion end 2 of the tobacco rod to travel through the filter rod towards the smoker (as indicated by the arrows). The smoke travels through the remaining (unburnt) tobacco rod 3 before entering the filter 5. The smoke first passes through the tobacco-end filter section 5C, then through the body 11 of the middle filter section (since the smoke is unable to pass into the grooves 7). The smoke then exits the filter 5 through the mouth-end filter section 5B.

When a smoker draws on the mouth-end section of the filter 5B, this also draws air into grooves 7 via the ventilation holes 17 and through the plug-wrap 13, as indicated by arrow A. In general, the flow resistance through the ventilation holes 17 and along grooves 7 is low compared to the flow resistance through the body portion 11 of the filter, for example.

After the air has entered a groove 7 as indicated by arrow A, the air is constrained to travel along the groove, as indicated by arrow B, since the groove walls, which are formed by non-porous inner plug-wrap 6 and tipping 15 papers, plus barrier 9, are generally impermeable. Accordingly, the incoming air finally exits the grooves 7 into the mouth-end filter portion 5B, where it mixes with and dilutes the mainstream smoke from combustion zone 2.

Figure 2:
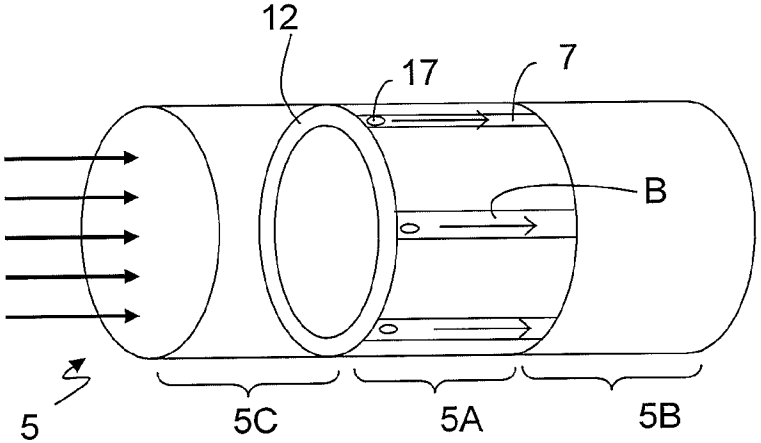
FIG. 2 is a schematic diagram of the filter of the cigarette of FIG. 1.

FIG. 2 is a further schematic view of the embodiment of FIG. 1. Thus, FIG. 2 is a perspective view illustrating the circumferential distribution of grooves 7 around a filter. In addition, FIG. 2 specifically shows the ventilation holes 17 located over the ends of the grooves 7 remote from the mouth-end of the filter. In one embodiment these ventilation holes 17 are formed via laser perforation, but any other suitable mechanism may be used. The ventilation holes may be sited directly over the grooves (as shown schematically in FIG. 2) or sited in a random band or bands which may or may not coincide with the grooves.

Figure 3:
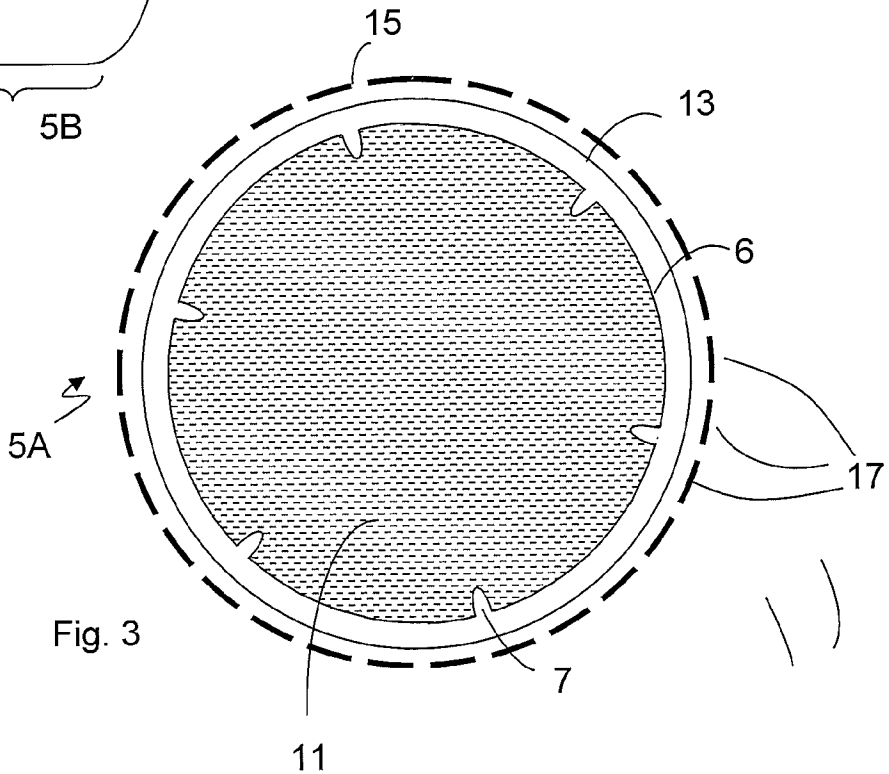
FIG. 3 is an axial cross-section of the filter of the cigarette of FIG. 1.

FIG. 3 is a cross-section through the filter 5 at the location of the ventilation holes 17 in the outer tipping 15. According to the embodiment shown in FIG. 3 the ventilation holes in the outer tipping do not all coincide with the grooves. Although there is a gap shown in FIG. 3 for clarity between the inner plug-wrap 6 and the outer plug-wrap 13, and likewise a gap between the outer plug-wrap 13 and the tipping paper 15, it will be appreciated that in practice no appreciable gaps are present, except for the grooves themselves.

It will be appreciated that the number and distribution of grooves 7, as shown in FIGS. 2, 3, and 4 is by way of example only. Other embodiments may have a different number and/or distribution of grooves.

Providing the grooves 7 in the filter 5 allows a separation between: (a) the location of the ventilation holes for incoming air, now at the end of the middle filter section 5A remote from the mouth; and (b) the location of the point where the ventilating air joins the main smoke flow, now at the junction between the middle filter section 5A and the mouth-end filter section 5B. The ability to separate these two locations gives more flexibility in the design and control of filter 5.

For example, placing the ventilation holes at the far end of the middle filter section 5A, away from the mouth end, reduces the risk that the ventilation holes are accidentally blocked by the mouth (e.g. lips) during smoking. In one particular embodiment, the ventilation holes are located at least about 11 mm from the mouth end of the filter, for example between about 12 mm and about 25 mm from the mouth end.

On the other hand, having the ventilation air entering the smoke flow of the filter relatively near the mouth causes smoke passing through the body 11 of the middle section to travel comparatively slowly, which in turn enhances the filtration efficiency of the body 11 of this filter section. In particular, since the smoke constituents spend longer in the vicinity of filter material 11 of the middle section, they have an increased likelihood of being adsorbed by this material. Accordingly, the filter material may comprise adsorbent material such as activated carbon or other suitable adsorbents.

Figure 4A:
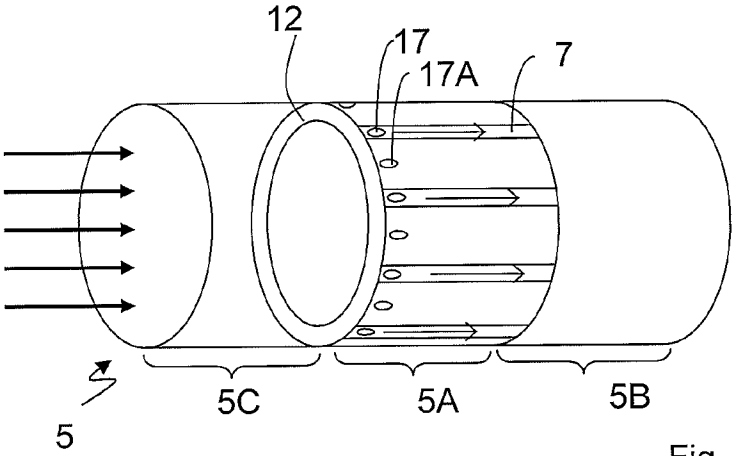
FIGS. 4*a* and 4*b* are schematic diagrams of the filter in accordance with two further embodiments of the invention having additional ventilation holes.
Figure 4B:
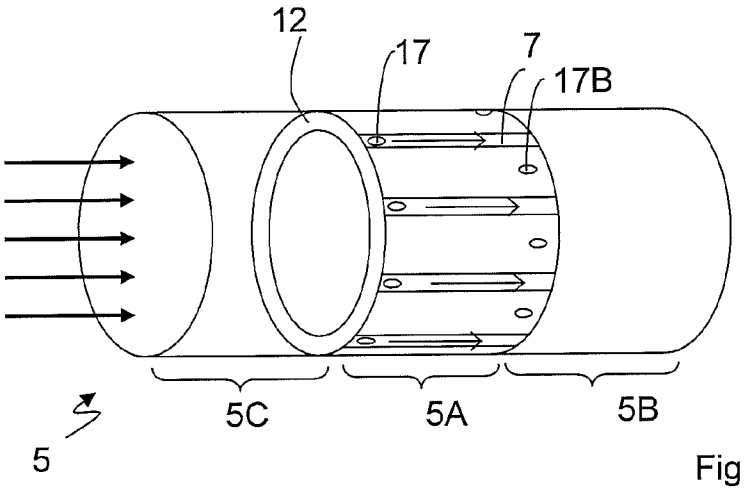

Two alternative embodiments are illustrated in FIGS. 4*a* and 4*b*. In both of these embodiments, additional ventilation holes are provided for the middle (grooved) filter section 5A. In the embodiment of FIG. 4*a*, the additional ventilation holes 17A are provided at the far end of the middle filter section 5A, remote from the mouth; i.e. at the same end as the ventilation holes 17 into the grooves. However, the circumferential positioning of these holes 17A is such that they do not lie above the grooves. Thus, air passes through the ventilation holes 17A directly into the main body 11 of filter material for filter section 5A. Accordingly, the air passing through the ventilation holes 17A does not bypass the filter material 11 of the middle filter section 5A, in contrast to the air entering through the ventilation holes 17, which is channelled by the grooves directly towards the mouth-end filter section 5B.

The configurations of FIGS. 4*a* and 4*b* therefore provide two effective positions of entry for ventilating air, and so allow enhanced control of smoke and filter properties. For example, the additional ventilation provides increased dilution of the mainstream smoke, including carbon monoxide and tar. The additional ventilation also increases the flow speed through the filter body 11, which decreases the filtration efficiency for materials such as tar. In the embodiment of FIG. 4*b*, the additional ventilation holes 17B are provided at the mouth end of the grooved section 5A. The air passing through ventilation holes 17B therefore enters the main portion of filter 5 at a slightly upstream position to the air entering through ventilation holes 17 (and travelling along grooves 7). The overall result of the configurations of FIGS. 4*a* and 4*b* are to provide increased ventilation and hence increased smoke dilution compared to the arrangement of FIG. 2.

It will be appreciated that the embodiments of FIGS. 4*a* and 4*b* may be combined in a single embodiment that has both additional ventilation holes 17A and additional ventilation holes 17B. That is, additional ventilation holes at both ends of the grooved filter section 5A. It will also be appreciated that the ventilation provided either into the grooves 17, or as additional ventilation via perforations 17A or 17B, can be provided in a wide band or zone across part or all of the filter section 5A.

It will also be appreciated that the number of filter sections may be different from the 3 filter sections shown in FIGS. 1, 2 and 4. For example, some multi-segment filters may only have 2 filter sections, while other multi-segment filters may have four, five or more filter sections. In general, the grooved filter section is separated from the mouth end of the filter by at least one other filter section (to help avoid lip blocking). Furthermore, while the grooves in FIGS. 1-4 have been shown extending the full length of the grooved filter section 5A, in other embodiments the grooves may extend only partway along the grooved filter section. In such a case the grooves may start away from the tobacco end of the section and/or terminate away from the mouth end of the section. Conversely, in some cases the grooves may extend (wholly or partially) across multiple filter sections.

Figures 5A, 5B, 5C, 5D:
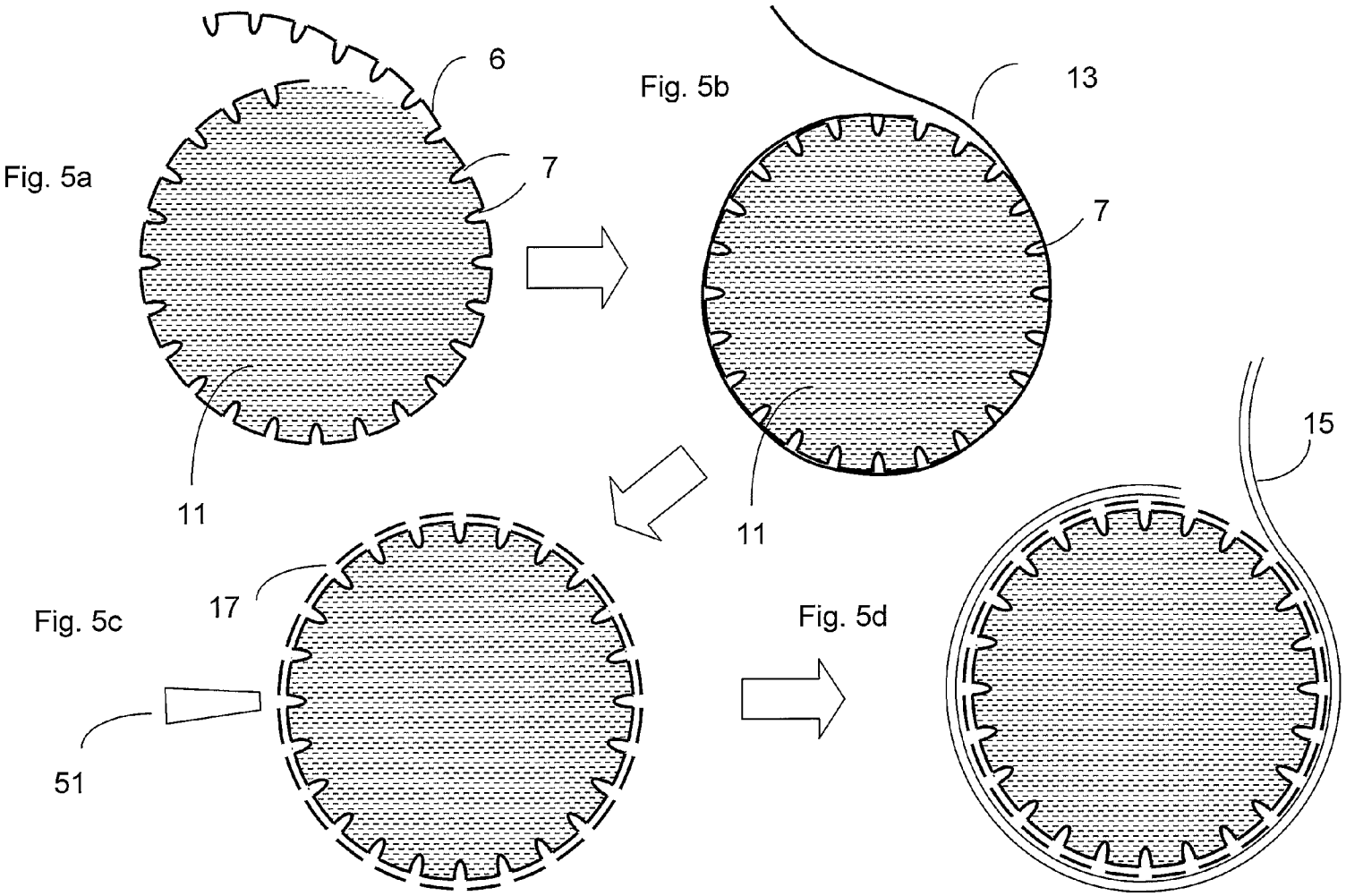
FIGS. 5*a* to 5*d* form a schematic illustration of the assembly of a grooved filter section in accordance with one embodiment of the invention.

FIG. 5 illustrates a method of manufacturing a filter in accordance with one embodiment of the invention. In this example, a sheet of non-permeable plug-wrap material 6 is corrugated or embossed to produce the grooves 7. The grooved material is wrapped around a cylinder of filter material 11 (FIG. 5*a*). The grooves shown in FIG. 5 have a U-shaped profile, but may have any other suitable profile, for example, V-shaped, or with square corners at the top and bottom. While the grooves (FIG. 5*a*) are shown as being on the inner surface of plugwrap material 6, hence creating channels within the body of the filter material itself, it will be appreciated that channels may form externally to the main body of the filter material 11. In addition the number and spacing of the grooves may vary from one embodiment to another. For example, there may be continuous V-shaped grooves (no spacing), so that the inner plug-wrap in effect has a zigzag configuration.

In the approach of FIG. 5, a layer of outer plug-wrap material 13 is now wrapped around the outside of the grooved filter rod (FIG. 5*b*). The grooves 7 in the inner plug-wrap material therefore become closed channels between the inner plug-wrap 6 and the outer plug-wrap 13. The outer plug-wrap 13 may be used to bind the filter section 11 with one or more other filter sections if so desired.

Additional ventilation holes 17 may be formed in the outer plug-wrap 13 using laser 51 (FIG. 5*c*). Although the outer plug-wrap 13 is shown separated from the inner plug-wrap 6 for clarity, again they will in practice be touching, as shown in FIG. 5*b*, except where the grooves are located. The ventilation holes 17 coincide with the grooves 7, and therefore provide entrance holes for air to pass into the grooves. Additional ventilation holes may be provided which are not linked to the grooves (as illustrated above in FIGS. 4*a* and 4*b*). Such ventilation holes may be formed passing through both the outer and also the inner plug-wrap as well as the outer tipping paper.

A further layer of sheet material 15, commonly known as tipping paper, may be subsequently applied to the ventilated wrapper and overlays the grooved filter section 5A (FIG. 5*d*). The tipping paper may be used to join the combined filter sections to the tobacco rod thereby securing together the components of a complete cigarette 1. The tipping paper may be permeable (pre-perforated) or impermeable. Impermeable tipping paper may be ventilated by means of on-machine laser techniques.

In another embodiment, on-line continuous grooving is applied to a filter rod, for example by wrapping the impermeable inner plug-wrap around the whole length of the rod, then grooving by passing through a shaped former. This filter rod can then be segmented for combination with other segments in a multi-element filter. Alternatively, discontinuous grooving may be applied to the filter rod, for example by impressing discontinuous grooves into the wrapped rod, using heated formers.

Where continuous grooving methods are used, the grooves are closed to the element on the tobacco side of the grooved section by any suitable technique. For example, an outer annulus (doughnut) made of plastic may be inserted between the two elements (as illustrated in FIG. 1). Another possibility for this sealing is to apply glue to the end of the groove furthest from the mouth.

Where discontinuous grooving methods are used, the filter segments are combined in such a way that the grooves do not reach the end of the tobacco side of the filter section.

The grooves or channels may be formed by any of the known methods. For example in some embodiments, the grooves may be formed directly in the filter material, such as by heat forming of cellulose acetate filters. In other embodiments, the non-permeable inner plug-wrap may be shaped or embossed prior to being wrapped around a cylinder of filter material.

In some embodiments, continuous grooving is applied, by any suitable means, to a length of filter rod, which is subsequently segmented. In other embodiments, grooving is applied to pre-sized filter sections.

In some embodiments a layer of permeable plug-wrap may be used to further encapsulate the grooved filter section. This permeable plug-wrap may also function to combine two or more filter sections.

The barrier 9 may be formed by any suitable material and/or mechanism. For example, one option is to apply a spot or band of glue or other non-permeable material into each groove 7. Another option is to provide an annulus of non-permeable material, e.g. plastic, that goes around near the circumference of the filter 5, and separates (and blocks off) the grooves 7 from the tobacco-end filter section 5C. Another possibility is to provide barrier 9 by hot melt fusion of the filter material 11.

A further layer of perforated or non-perforated sheet material 15, commonly known as tipping paper, is subsequently applied to the combined filter and overlays the outer plug-wrap. The tipping paper may be used to join the combined filter to the tobacco rod. The tipping paper may be adhered to the filter and the tobacco rod, by any suitable means, but may retain a largely non-adhered portion over the grooved section 5A.

In some embodiments, tipping paper perforations may be provided by means of a laser, or by other suitable means. Tipping paper may be perforated before or after being bound to the filter.

The tipping paper is adhered to the three filter sections using a skip gap gluing technique such that a largely glue free area is positioned between the ventilation holes and the plug-wrap overlying the grooves. It will be appreciated that using adhesives to join the three layers (inner plug-wrap, outer plug-wrap and tipping) together at the position where the ventilation holes occur would result in blocking of the air-flows and therefore the area is left predominantly non-glued.

The skilled person will be aware of various modifications that may be made to the embodiments described above. Accordingly, the scope of the present invention is defined by the appended claims and their equivalents.

The invention claimed is:

1. A smoking article, comprising: a tobacco rod and a multi-section filter combined via a tipping paper having ventilation holes, the multi-section filter including:

a first filter section disposed at a mouth end of the filter; and a second filter section adjacent to the first filter section, the second filter section including a set of grooves, wherein the grooves extend from some but not all of the ventilation holes in the tipping paper along the second filter section towards the first filter section, and wherein the filter further includes a non-permeable barrier at a distal end of the grooves opposite from the first filter section, such that, in use, the barrier prevents smoke from being drawn into the grooves and facilitates air flow into the grooves via the ventilation holes.

2. The smoking article according to claim 1, wherein the grooves extend along the outside of the filter substantially parallel with a major axis of the filter.

3. The smoking article according to claim 1, wherein the grooves are substantially non-permeable along their length.

4. The smoking article according to claim 1, wherein a body of the second filter section is separated from the grooves in said section by a further non-permeable barrier.

5. The smoking article according to claim 1, wherein at least one of the filter sections comprises adsorbent material.

6. The smoking article according to claim 1, wherein, in use, air enters the grooves from the ventilation holes via a permeable membrane.

7. The smoking article according to claim 1, wherein the filter is configured such that, in use, air passes through the ventilation holes, travels along the grooves towards the first filter section and exits the grooves into a body portion of the filter adjacent the first filter section.

8. The smoking article according to claim 1, wherein all the air entering through the ventilation holes is directed along the grooves.

9. The smoking article according to claim 1, wherein some of the ventilation holes, are directed into a body portion of the second filter section.

10. The smoking article according to claim 9, wherein the ventilation holes that are directed into the body portion are located near the ends of the grooves furthest away from the first filter section.

11. The smoking article according to claim 9, wherein the ventilation holes that are directed into the body portion are located near the ends of the grooves closest to the first filter section.

12. The smoking article according to claim 1, wherein the ventilation holes are located more than umm from the mouth end of the first filter section.

13. The smoking article according to claim 12, wherein the ventilation holes are located about 12 to 25 mm from the mouth end of the first filter section.

14. The smoking article according to claim 1, wherein the grooves extend substantially the length of the second filter section.

15. The smoking article according to claim 1, wherein the non-permeable barrier is hot melt fusion of filter material.

16. The smoking article according to claim 1, wherein the non-permeable barrier is glue.

17. The smoking article according to claim 1, wherein the non-permeable barrier is an annular member located at the distal end of the second filter section opposite from the first filter section.

18. The smoking article according to claim 1, wherein the multi-section filter further includes a third filter section, and configured such that the three filter sections are in an end-to-end arrangement, the second filter section disposed between the first filter section and the third filter section.

19. The smoking article according to claim 1, wherein the second filter section has an inner plug-wrap and an outer plug-wrap, and wherein the inner plug-wrap is non-permeable and the outer plug-wrap is permeable.

20. A method of making a smoking article, comprising:

combining a grooved filter section and a mouth-end filter section of a multi-section filter by overlaying the grooved filter section with a permeable plug-wrap, the grooved filter section including a set of grooves extending along the grooved filter section towards the mouth-end filter section; and overlaying the combined grooved and mouth-end filter sections with a tipping paper containing ventilation holes such that, the position of some but not all of the ventilation holes corresponds to the position of the grooves, wherein the grooves are blocked by a non-permeable barrier at an end of the grooves opposite to the mouth-end filter section during the combining.

21. The method according to claim 20, further comprising: shaping a filter rod to form the grooved filter section.

22. The method according to claim 20, further comprising: shaping a plug-wrap and wrapping the shaped plug-wrap around a filter rod to form the grooved filter section.

23. The method according to claim 20, further comprising: forming the ventilation holes in the tipping paper using on-line perforation and/or off-line perforation.

24. The method according to claim 20, further comprising: forming the non-permeable barrier by addition of adhesive.

25. The method according to claim 20, further comprising: forming the non-permeable barrier by hot melt fusion of filter material.

26. The method according to claim 20, further comprising: forming the non-permeable barrier by addition of an annular material at the end of the grooved filter section.

27. A smoking article, comprising: a tobacco rod, a multi-section filter, and a tipping paper, the tipping paper joining the tobacco rod and the multi-section filter and having ventilation holes, the multi-section filter including:

a first filter section disposed at a mouth end of the filter;

a second filter section adjacent to the first filter section, the second filter section having a plurality of grooves extending from some of the ventilation holes in the tipping paper, along the second filter section towards the first filter section, and other of the ventilation holes configured to direct air into a body portion of the second filter section; and barrier material at an end of the grooves distal the first filter section, the barrier material configured to facilitate air flow into the grooves via the ventilation holes.

* * * * *